US005433039A

United States Patent [19]

Hawkins et al.

[11] Patent Number: 5,433,039

[45] Date of Patent: Jul. 18, 1995

[54] TWO-WAY MOTOR VEHICLE DOOR

[75] Inventors: Clive A. Hawkins, Chichester, England; Rolf Samulewicz, Oceanside; Osraldo E. Villafane, Costa Mesa, both of Calif.

[73] Assignee: Isuzu Motors Limited, Tokyo, Japan

[21] Appl. No.: 135,889

[22] Filed: Oct. 13, 1993

[51] Int. Cl.[6] ..... E05D 7/02

[52] U.S. Cl. ..... 49/382; 16/DIG. 23; 49/193

[58] Field of Search ..... 49/192, 193, 382, 503; 292/DIG. 3, DIG. 43, DIG. 29; 16/DIG. 23, 232; 296/50

[56] References Cited

U.S. PATENT DOCUMENTS

| | | | |
|---|---|---|---|
| 4,503,583 | 3/1985 | Frohbieter | 16/DIG. 23 |
| 4,612,728 | 9/1986 | Moriyoshi | 49/382 X |
| 5,209,016 | 5/1993 | Yamada | 49/382 X |
| 5,212,849 | 5/1993 | Aihara | 16/DIG. 23 |

FOREIGN PATENT DOCUMENTS

| | | | |
|---|---|---|---|
| 153184 | 6/1990 | Japan | 49/193 |
| 229383 | 9/1990 | Japan | 49/382 |
| 3036385 | 2/1991 | Japan | 49/382 |

*Primary Examiner*—Jerry Redman
*Attorney, Agent, or Firm*—Thomas A. Gallagher

[57] ABSTRACT

A motor vehicle door, particularly for use as a rear door for a station wagon type or a sports utility type vehicle is openable from either the left side or the fight side. Mirror image mechanisms are provided at each side of the door to provide locking, unlocking and hinging at each side. A safety cam is included in each mechanism and the mechanisms communicate with each other so that the unlocking of one side prevents the unlocking of the other side. When both sides are locked, either one or the other side may be opened, in which case the unopened side acts as a hinge. The safety cam interlock arrangement prevents the opening of both sides at the same time.

5 Claims, 6 Drawing Sheets

TWO-WAY MOTOR VEHICLE DOOR

BACKGROUND OF THE INVENTION

This application relates generally to doors for motor vehicles. More particularly, the invention relates to a two-way opening door for a motor vehicle. Such a door is particularly useful as a rear door for a sports utility type or station wagon type vehicle.

SUMMARY OF THE INVENTION

In accordance with the teachings of the present invention a two-way opening door for a motor vehicle is provided. First and second ends of the door have integral first and second opening, locking and hinging means, respectively. Each opening, locking and hinging means is substantially the mirror image of the other. Each opening, locking and hinging means includes means for selectively engaging respective hinge and locking shaft means held by the motor vehicle. The first and second opening, locking and hinging means include means for preventing the unlocking and opening of the respective opening, locking and hinging means, the means for preventing including means communicating the first opening, locking and hinging means with the second opening, locking and hinging means, the communicating means cooperating with the means for preventing the opening of the respective locking means so that when said first opening, locking and hinging means is open, said second opening, locking and hinging means is prevented from unlocking and opening and when said second opening, locking and hinging means is open, said first opening, locking and hinging means is prevented from unlocking and opening. The first and second opening, locking and hinging means each include a manually operative unlocking lever.

In a preferred embodiment, locking cams cooperate with other shaft engaging members to lock the door end to locking and hinging shafts when the door end is in its locked position. A safety cam prevents unlocking of each locking cam when the opposite end of the door is open.

The arrangement provides a simple, yet secure, two-way door for a motor vehicle. Such a two-way opening arrangement allows the vehicle user greater flexibility in access to the interior of the vehicle.

BRIEF DESCRIPTION OF THE DRAWINGS

FIG. 5 a diagrammatic top plan view similar to FIG. 5 but showing the arrangement in its closed, locked and safety on position.

DETAILED DESCRIPTION OF THE PREFERRED EMBODIMENT

Figure 1:
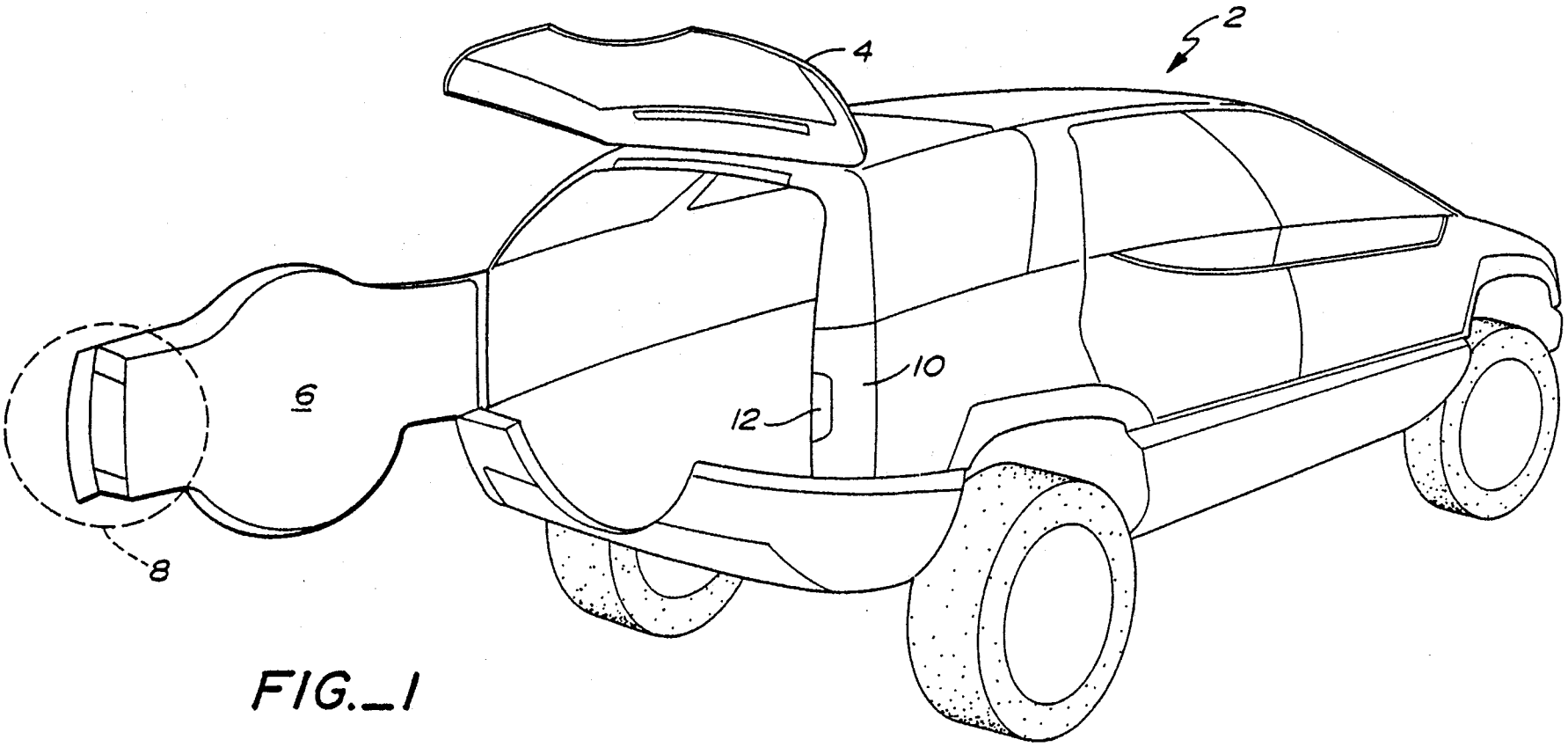
FIG. 1 shows a right rear perspective view of a vehicle having a two-way opening rear door in accordance with a preferred embodiment of the invention.
Figure 2:
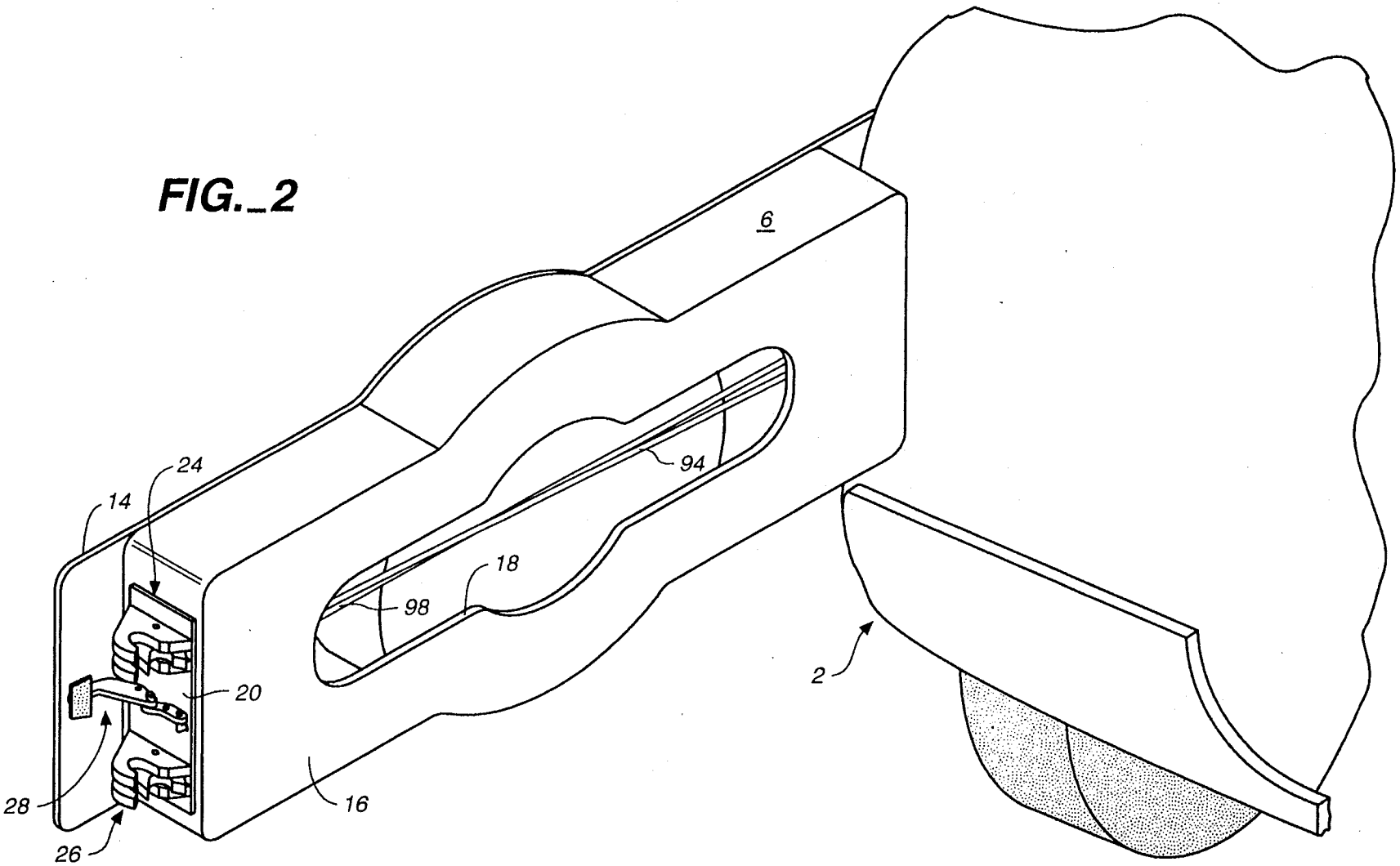
FIG. 2 is a perspective diagrammatic view showing the door opening, locking and hinging assembly and manually operative unlocking lever of FIG. 1 in greater detail.

Referring now to the drawings, FIG. 1 shows a perspective view of a vehicle 2 having a two-way opening rear door 6 in accordance with a preferred embodiment of the present invention. Above the two-way door 6 is an upwardly hinging rear window 4. Although the door is shown as opening at the right side and hinging the left side, it is to be understood that the door also operates in the opposite manner, opening at the left side and hinging from the right side. Details of the door lock assembly and unlocking lever 8 are shown in FIG. 2 and subsequent figures. The fight hand vehicle tail light 10 is visible in the Figure; the left hand tail light is blocked by the open door 6. A cut out region 12 is provided in the tail light lens to allow the manual engagement of right-hand door-opening handle. The left hand tail light assembly is a mirror-image of the right hand one, also providing a cut out in the tail light lens to allow the manual engagement of left-hand door-opening handle.

FIG. 2 shows the door lock assembly and unlocking lever 8 of FIG. 1 in greater detail. The door 6 includes a generally rectangular box-like enclosure 16 having a cutout portion 18 through which a pair of rods 94 and 98 are visible. As will be explained hereinafter, rods 94 and 98 communicate between the left-hand and right-hand opening, locking and hinging assemblies to assure that when the door is opened at one side it cannot be opened at the other side. In a finished vehicle, the cutout 18 is covered. The enclosure 16 is mounted to the exterior door surface wall 14. The door 6, including enclosure 16 and exterior surface 14, has a circular central portion suitable for holding an exteriorly-mounted spare fire. At the right hand end of the enclosure 16 a mounting plate 20 is affixed. The mounting plate 20 holds an upper opening, locking and hinging assembly 24, a lower opening, locking and hinging assembly 26 and a door opening lever and mechanism 28. A mirror image of plate 20, assemblies 24 and 26 and handle and mechanism 28 are provided at the left end of the door 6, which is not visible in this view. When the door is open, as shown in FIGS. 1 and 2, the right hand assemblies and mechanisms are in their unlocked and open condition, as shown in FIGS. 1 and 2 (and in FIG. 3, as described hereinafter). The left hand assemblies and mechanisms are in their locked and closed condition, as described hereinafter.

Figure 3:
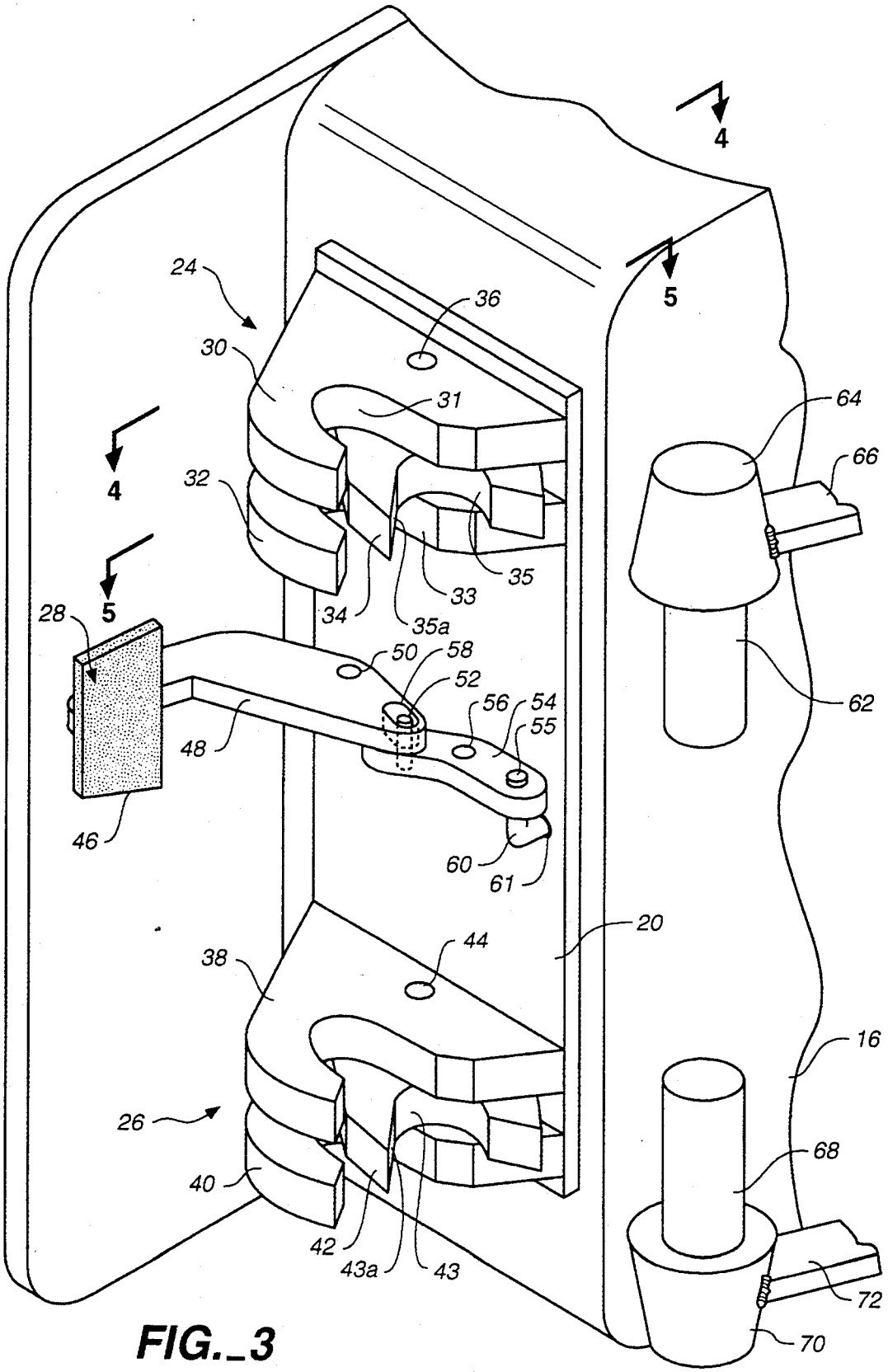
FIG. 3 a perspective diagrammatic view showing the door opening, locking and hinging assembly and manually operative unlocking lever in still greater detail.

Referring now to the diagrammatic view of FIG. 3, assemblies 24 and 26 and opening lever mechanism 28 are shown in greater detail. The upper opening, locking and hinging assembly 24 has first and second generally C-shaped hinge engaging and locking members 30 and 32, respectively. Members 30 and 32 have open jaws for receiving and partially encircling a hinge and locking shaft. Members 30 and 32 are spaced apart and hold between them a generally C-shaped locking cam 34, also having an open jaw for the same purpose, which hinges on pin 36 carried by members 30 and 32. A portion of cam 34, having a camming surface, including a cam locking surface, passes through a slot (not shown in this view) in plate 20 and the underlying wall of enclosure 16. Members 30 and 32 have generally C-shaped jaw openings 31 and 33 respectively, which permit the members to partially encircle and mate with an upper hinge and locking shaft 62 as the door is rotated so that members 30 and 32 engage shaft 62. Shaft 62 is a fight circular cylinder having an outer diameter slightly smaller than the diameter of the circular openings 31 and 33 in members 30 and 32. The dimensioning should allow the hinging of the door on the shaft, while also providing a sufficiently tight lock when closed. Shaft 62 has a crown 64. The lower diameter of crown 64 is sufficiently greater than the diameter of shaft 62 so as to provide an upper stop against movement of the members along shaft 62. In cooperation with a crown on a lower hinge and locking shaft, described hereinafter, the door is held in place vertically and is constrained from moving up or down along its left and fight hinges. A support arm 66 fixed to the vehicle body in a manner not shown supports crown 64 and shaft 62.

The lower hinge engaging and locking assembly 26 is identical to the upper assembly 24. It includes members 38 and 40 and a cam 42 hinging on pin 44. Members 38 and 40 also have generally C-shaped jaw openings, which permit the members to partially encircle and mate with a lower hinge and locking shaft 68 as the door is rotated so that members 38 and 40 engage shaft 68. Shaft 68 is the same as shaft 62, but is oriented upward rather than downward. Shaft 68 has a crown 70 in the same manner as crown 64 for the same purpose. A support arm 72 fixed to the vehicle body in a manner not shown supports crown 70 and shaft 68. Shafts 62 and 68 are in two pieces rather than one in order to provide space for the opening lever mechanism 28 when the door side is closed.

Cams 34 and 42 are biased by a spring (not shown in this view) to the positions shown in this FIG. 3. Cams 34 and 42 both have a surface (35*a* and 43*a*, respectively on their hinge and locking shaft engaging surfaces) which first engages the respective shafts 62 and 68 and causes the cam to rotate clockwise (as viewed in FIG. 3) as the door is closed. As explained further below in connection with other Figures, after the cams 34 and 42 have rotated into their locked positions, the combination of members 30, 32, 38 and 40 and cams 34 and 42 captures the respective locking and hinge shafts 62 and 68, locking this side of the door but also allowing hinging of this side of the door on shafts 62 and 68 when the other side of the door is opened. Cam 42, as does cam 34, also has a camming surface portion which passes through a slot (not shown in this view) in plate 20 and the underlying wall of enclosure 16.

Continuing the description of FIG. 3, the door opening lever and mechanism 28 includes a trapezoidally-shaped manually engageable unlocking handle 46 fixed to the end of a generally L-shaped unlocking lever arm 48. Arm 48 is hinged on pin 50 carried by mounting plate 20. The distal end of arm 48 has an elongated slot 52 in which a pin 58 rides. Pin 58 is held by a slightly U-shape curved unlocking link member 54 which is hinged on pin 56 carried by mounting plate 20. The distal end of member 54 has a bearing hole 55 in which the end of an L-shaped unlocking rod 60 is pivotally connected. Rod 60 passes through a hole 61 in plate 20 and the underlying wall portion of enclosure 16. In the open position, as shown in this FIG. 3, member 48 is rotated clockwise, thus also causing member 54 to rotate clockwise until the portion of member 54 between hinge pin 56 and rod 60 engages plate 20. As members 48 and 54 rotate clockwise, member 54 moves rod 60, pushing it through hole 61 in the direction into plate 20. As will be described hereinafter, rod 60 actuates other mechanisms (not shown in this view, but described hereinafter).

Although this preferred embodiment describes a manually actuated opening lever arrangement, those of ordinary skill in the art will appreciate that the invention is not limited to manual actuation. For example, the opening lever may be electrically, electro-mechanically, pneumatically or electro-pneumatically actuated.

Figure 4:
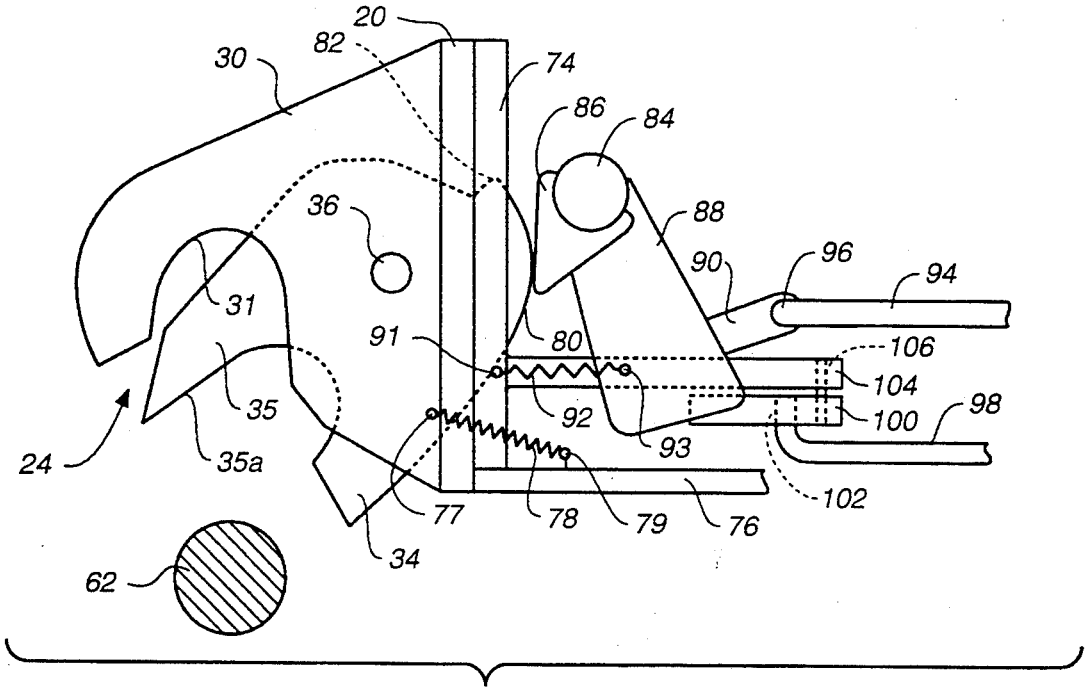
FIG. 4 is a diagrammatic top plan view taken generally along section lines 4—4 in FIG. 3.

FIG. 4 is a diagrammatic top plan view taken generally along section lines 4—4 in FIG. 3. For clarity and simplicity, the Figure is directed principally to the upper mechanism 24. The door opening handle mechanism 28 and the lower mechanism 26 are not shown in FIG. 4. The end portion of enclosure 16 is shown as wall member 74 and the front portion of enclosure 16 (the inside surface of the door) is shown as wall member 76. One end of biasing spring 78 is attached to cam 34 at point 77 and the other end is attached to the wall 76 at point 79. As mentioned hereinbefore, the spring biases the cam in the position shown in FIGS. 2, 3 and 4. FIG. 4 shows the rear portion of cam 34 (and cam 42, which is identical), which is hidden in the view of FIG. 3. Cam 34 has a camming surface 80 along which a cam follower 86 rides. Cam follower 86 is attached to a control shaft 84 which is in turn connected (at a different location along its length, as will be described further hereinafter, particularly in connection with FIG. 6) to a control arm 88. A spring 92 connected between a point 91 on wall 74 and a point 93 on the control arm 88, biases the control shaft so that the cam follower 86 follows the cam surface 80. As the vehicle door is closed, surface 35*a* of cam 34 engages shaft 62. As the door continues its closing motion, the shaft 62 rides along the cam jaw surface 35 causing cam 34 to rotate clockwise (as seen in FIG. 4) along its axial pin 36 until the cam follower 86 is caught by the locking ridge 82 on the camming surface 80.

Figure 6:
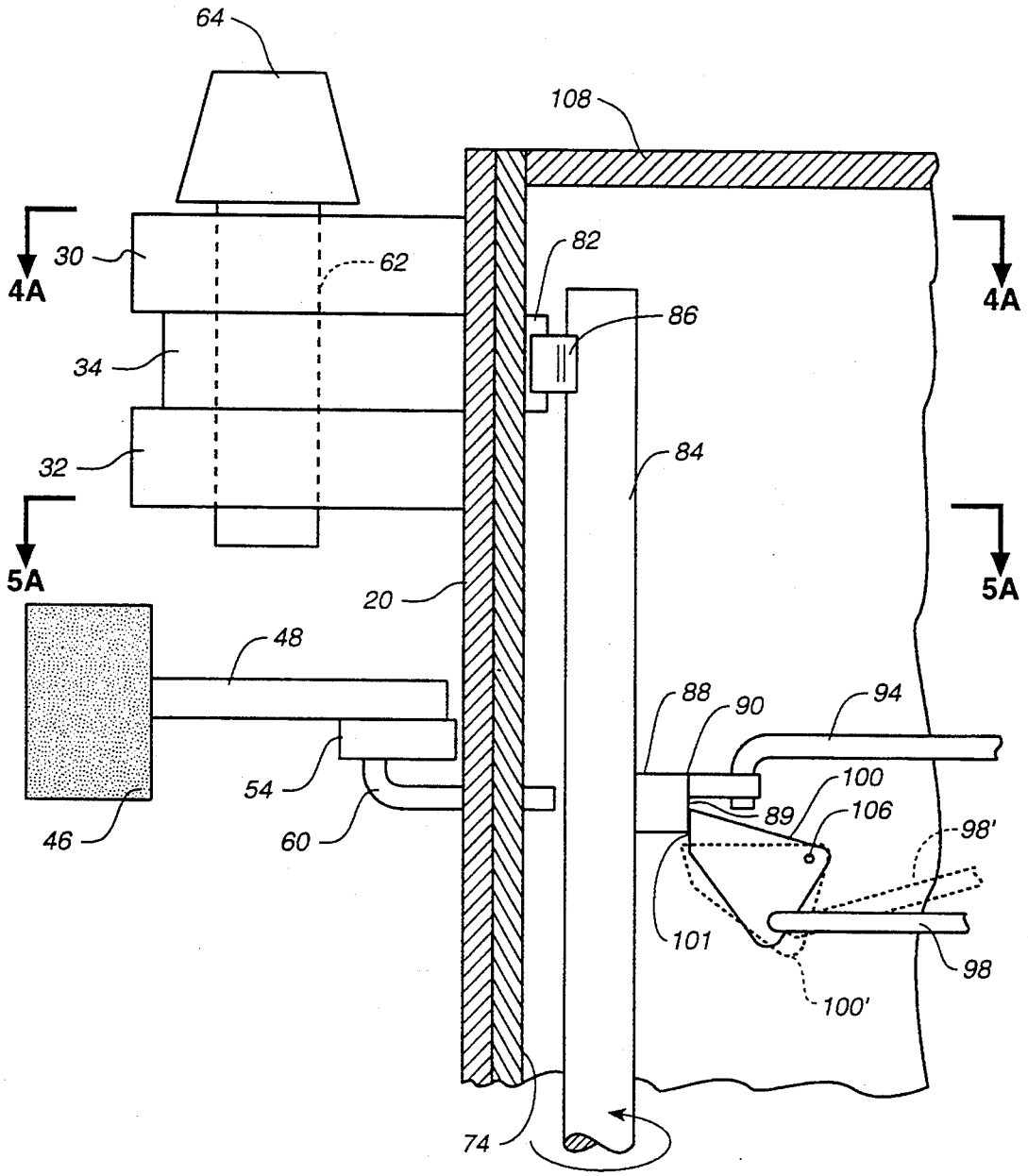
FIG. 6 is a diagrammatic side elevation view taken generally along section lines 6—6 of FIGS. 4A and 5A.

Control arm 88 has a shaft link extension arm 90 fixed to it. The distal end of arm 90 has a beating hole 96 through which the L-shaped end of a rod 94 is pivotally connected. (The L-shape is best seen in FIG. 6.) Rod 94 is one of the two rods (the other being rod 98, as mentioned hereinbefore) which extend between and communicate the fight-hand and left-hand door hinging and locking mechanisms. The other rod, rod 98, is pivotally attached to a bearing hole 102 in a safety cam 100 which pivots on a hinge pin 106 held by a support bracket 104 which is mounted on wall 74. As will be explained further hereinafter, in response to movement of rod 98, safety cam 100 prevents control arm 88 from moving from its locked position to its open position (as shown in FIGS. 2, 3 and 4). The safety locking effect of cam 100 is best seen in FIG. 6. Rods 94 and 98 cross over between the right-hand hand and left-hand hinging and locking mechanisms (the control arm of one mechanism is mechanically coupled by a rod to the safety cam of the other mechanism and vice-versa) such that movement of rod 94 to right (as viewed in FIG. 4), resulting from the open condition in the left-hand mechanism causes the safety cam in the other mechanism to place the control arm of the other mechanism in its locked and closed position.

Figure 5:
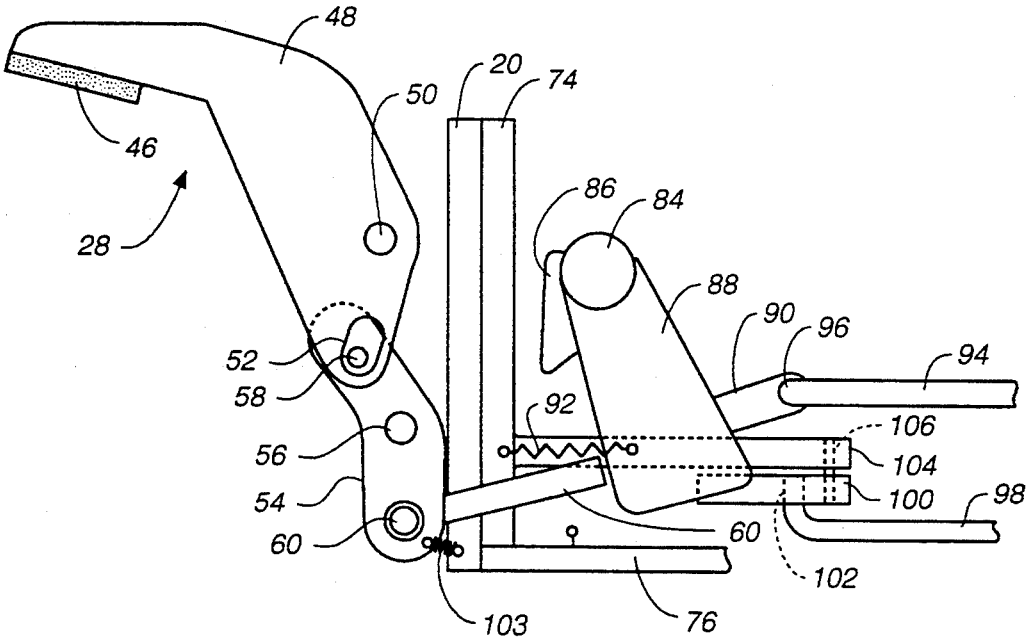
FIG. 5 is a diagrammatic top plan view taken generally along section lines 5—5 in FIG. 3.

FIG. 5 is a diagrammatic top plan view taken generally along section lines 5—5 in FIG. 3. For clarity and simplicity, the Figure is directly principally to the door opening handle and mechanism 28 and related mechanisms and does not include the lower mechanism 26. In the open position, as shown, member 54 engages the mounting plate, compressing spring 102 (which assists in the manual door opening) and extending rod 60 to its fullest extent, thus rotating the control arm 88 and control shaft 84 to their fullest counterclockwise position (as viewed in FIG. 5). As a result, rod 94 places the counterpart safety cam (not shown) in the mechanism at the other side of the door to the extreme of its locked position.

Figure 4A:
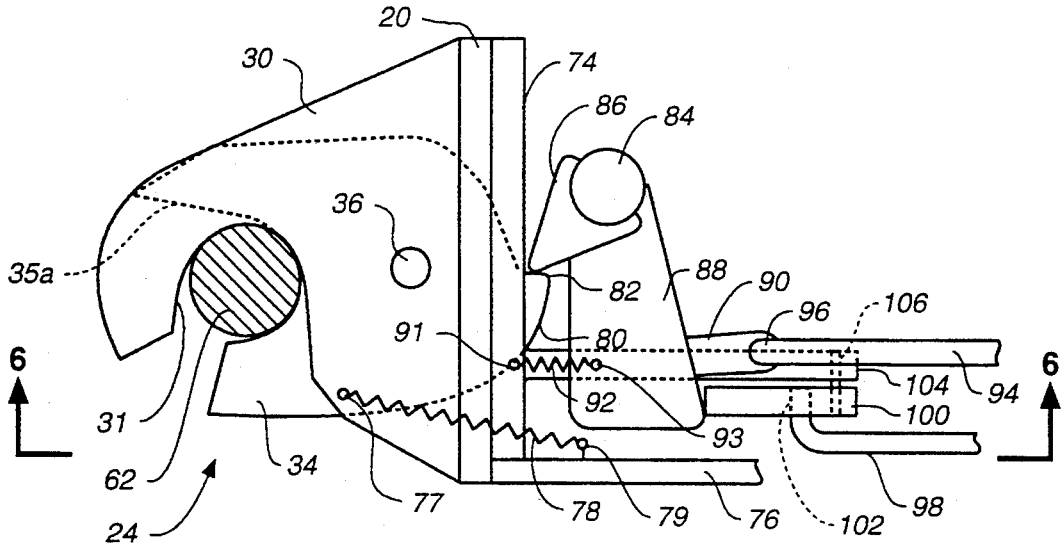
FIG. 4A is a diagrammatic top plan view similar to FIG. 4 but showing the arrangement in its closed, locked and safety on position.

FIG. 4A shows the same structure as in FIG. 4, but with the mechanism in the locked and safety "on" position. Thus, the shaft engaging portions 31, 33 and 35 of members 30, 32 and 34, respectively, (member 32 and its shaft engaging portion is not shown in FIG. 4 for clarity and simplicity) encircle a substantial portion of the circumference of the shaft 62, while the cam follower 86 engages the locking ridge 82 of the camming surface 80, assuring the entrapment of the shaft 62. At the same time, members 38, 40 and 42 of the lower mechanism 26 entrap shaft 68 in the same manner. Although the Figure also shows the safety on (i.e., the safety cam is holding the control arm 88 and control shaft 84 from moving, thereby preventing this side of the door from being opened), it is also possible for the door to be in its locked position (i.e., cam follower 86 biased against the cam locking ridge 82) without the safety "off." If the opposite door side is open, the safety on the side shown in FIG. 4A is on (as shown). If the opposite door side is closed, the safety on the side of the door under discussion in FIG. 4A is off (the safety "off" condition is not shown in FIG. 4A).

Figure 5A:
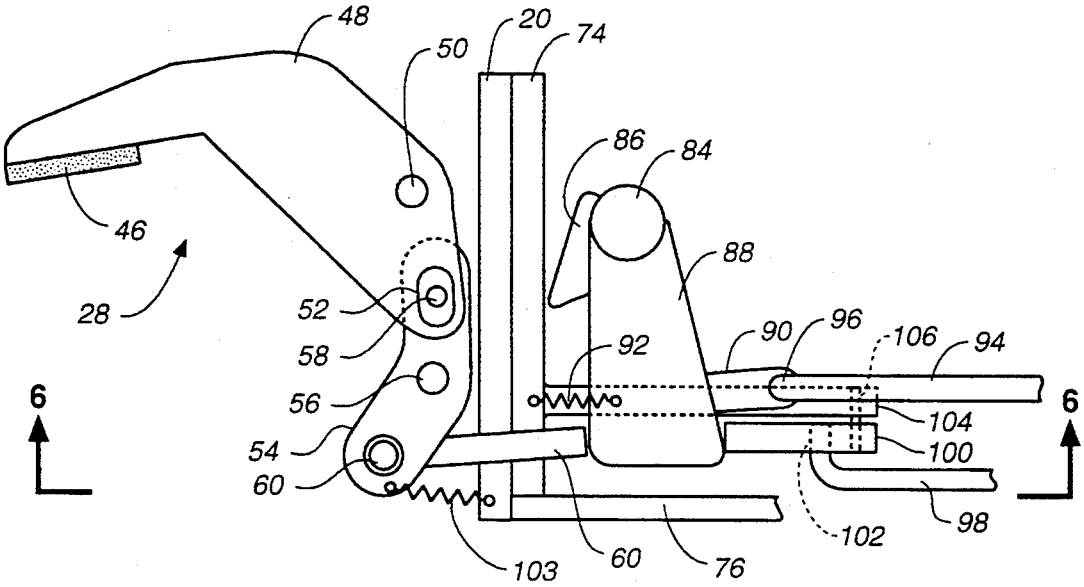

FIG. 5A shows the same structure as in FIG. 5, but for the locked and safety "on" conditions as in FIG. 4A. In FIG. 5A it will be noted that the link member 54 is rotated clockwise so that the rod 60 is pulled outwardly from the hole 61 and the arm 48 and handle 46 also rotate counterclockwise to their door closed position.

FIG. 6 is a sectional view along section lines 6—6 of FIGS. 4A and 5A. FIG. 6 is particularly useful in understanding the operation of the safety cam 100. In FIG. 6 cam 100 is seen as shaped generally as a parallelogram, having an end 101 which engages the surface 89 of the control arm 88 when the cam is in its "safety on" position. Safety cam 100 is pivoted on pin 106 by movement of the control rod 98. In the safety on position as shown in FIG. 6, the cam surface 101 prevents movement of member 88 from its locked position. The arrow surrounding control shaft shows the direction of rotation which is prevented by the safety cam 100 acting against member 88. Rod 98 places cam 100 in this position when the opposite door side is unlocked. When the opposite door side is locked, rod 98 moves the right, causing cam 100 to move to position 100' (shown in phantom). The cam movement to position 100' also causes some displacement of the rod 98 to position 98' (shown in phantom).

In operation, assume first that both the fight and left side of the door are locked. This situation is shown in FIGS. 4A, 5A and 6 except that the safety cam would be in its off position for both sides of the door (e.g., position 100') when both sides are locked. It should be understood that a particular side of the door is "locked" in the sense that the assemblies 24 and 26 entrap the hinge pins 62 and 68 when the cam follower 86 (see FIG. 4A, for example) is caught by the cam locking ridge 82 on cam 34. In this "locked" condition the safety cam 100 may or may not be in its "safety on" condition depending on whether or not the opposite side of the door is open.

To open the fight hand side of the door, for example (the operation of the other side being analogous), sufficient unlocking force is applied to the handle 46 to overcome the counteracting force of springs 78 and 92 (spring 103 provides some opening assistance) so that the cam follower 86 (and its counterpart in the lower mechanism) causes cam 34 (and its counterpart cam 42) to rotate slightly in the clockwise direction to overcome the cam locking ridge 82, thus allowing the cam to then rotate counterclockwise to its open position (as shown in FIG. 4) with the assistance of spring 78. This is possible only if the other side of the door is closed so that the safety cam does not prevent rotation of control shaft 84. This operation, which involves counterclockwise rotation (as viewed in FIGS. 4, 4A, 5 and 5A) of the control shaft 84 and control arm 88, causes rod 94 to move to the right (as viewed in these same Figures). Rod 94 is coupled to the safety cam in the left hand door mechanism, causing that side of the door to remain firmly locked and preventing the left hand side of door from being opened. Thus, if the right side of the door is open, the left side cannot be opened and vice-versa. When both sides are closed, either one side or the other may be opened.

The mechanisms are dimensioned such that if an attempt is made to open both sides at once, neither side will open. One way to accomplish this is to dimension the locking ridge on cam 82 so that the initial movement imparted to rod 94, prior to the cam follower 86 overcoming the cam locking ridge 82, is sufficient to cause the safety cam in the opposite side of the door to prevent opening of that other side.

When one side of the door is open, the mechanism on the other side of the door provides a hinging action, the hinged side of the door being securely locked to the hinge shafts with the safety cam preventing the possibility of the hinge unlocking.

When the open door is closed, the cam jaw surfaces **35*a* and 43*a* of cams 34 and 42 engage the hinge and locking shafts 62 and 64, causing the cams to rotate clockwise (as viewed in FIG. 4). This cam rotation causes the cam followers (86 and its counterpart in the lower assembly) and control shaft 84 to rotate clockwise in response to the urging of spring 92 (and its counterpart in the lower assembly), thus retracting rod 94** and setting the safety cam in the opposite end door assembly to off.

The materials used for the various members, taking into account the requirements to provide sufficient weight bearing capacity for the door hinges and strength requirements prescribed for door and parts. The weight bearing members are preferably steel.

Although the invention has been disclosed in terms of the preferred embodiment disclosed herein, those skilled in the art will appreciate numerous modifications and enhancements which can be made without departing from the true spirit of the invention. All such modifications and enhancements are intended to be included within the scope of the following claims.

We claim:

1. A two-way opening door for a motor vehicle comprising a door having first and second ends, said first end having first opening, locking and hinging means integral therewith, said second end having second opening, locking and hinging means integral therewith, said first and second opening, locking and hinging means being substantially mirror images of one another, said first and second opening, locking and hinging means each including means for selectively engaging respective hinge and locking shaft means held by said motor vehicle, said first and second opening, locking and hinging means each including a manually operative unlocking lever movable from a locked to an unlocked position, said first and second opening, locking and hinging means including means for preventing the unlocking and opening of the respective locking means, said means for preventing including means communicating said first opening, locking and hinging means with said second opening, locking and hinging means, said communicating means cooperating with said means for preventing the opening of the respective locking means so that when the lever associated with said first opening, locking and hinging means is moved from its locked to its unlocked position said first opening, locking and hinging means is opened and said second opening, locking and hinging means is prevented from unlocking and opening, and when the lever associated with said second opening, locking and hinging means is moved from its locked to its unlocked position, said second opening, locking and hinging means is opened and said first opening, locking and hinging means is prevented from unlocking and opening, said communicating means comprising first and second independent mechanical links, one link signaling said first opening, locking and hinging means whether or not the second opening, locking and hinging means is open and the other link signaling said second opening, locking and hinging means whether or not the first opening, locking and hinging means is open.

2. A door according to claim 1 wherein said means for preventing the opening of said opening, locking and hinging means includes safety cam means.

3. A door according to claim 2 wherein said means for opening, locking and hinging means includes locking cam means.

4. A door according to claim 1 wherein said means for preventing the opening of said opening, locking and hinging means includes safety cam means.

5. A door according to claim 4 wherein said means for opening, locking and hinging means includes locking cam means.

* * * * *